US005779147A

United States Patent [19]

Rosse

[11] Patent Number: 5,779,147

[45] Date of Patent: Jul. 14, 1998

[54] DOSING NOZZLE ASSEMBLY AND PROCESS FOR DOSING LIQUID

[75] Inventor: Meinrad Rosse, La-Tour-De-Peilz, Switzerland

[73] Assignee: Nestec S.A., Vevey, Switzerland

[21] Appl. No.: 715,301

[22] Filed: Sep. 17, 1996

[30] Foreign Application Priority Data

Oct. 24, 1995 [EP] European Pat. Off. ..... 95202881

[51] Int. Cl.[6] ..... B05B 1/08; B05B 1/30; B65D 88/54

[52] U.S. Cl. ..... 239/99; 239/324; 239/574; 137/853; 222/309; 222/380

[58] Field of Search ..... 239/99, 321, 324, 239/574; 222/309, 372, 380, 383.1, 494; 137/853

[56] References Cited

U.S. PATENT DOCUMENTS

| | | | |
|---|---|---|---|
| 4,095,722 | 6/1978 | Miller | 222/1 |
| 4,410,108 | 10/1983 | Minard | 222/380 |
| 4,846,379 | 7/1989 | Warburton et al. | 222/482 |
| 5,027,983 | 7/1991 | Wakabayashi et al. | 239/574 X |
| 5,305,783 | 4/1994 | Debush | 137/853 |
| 5,407,102 | 4/1995 | Freudinger et al. | 222/309 |
| 5,660,205 | 8/1997 | Epstein | 137/853 X |

FOREIGN PATENT DOCUMENTS

| | | | |
|---|---|---|---|
| 0 402 535 | 12/1990 | European Pat. Off. . | |
| 1607945 | 9/1970 | Germany . | |
| 2841198 | 4/1980 | Germany . | |
| 3212089 | 10/1983 | Germany . | |
| 3921791 | 5/1990 | Germany . | |
| 8707377 | 12/1987 | WIPO | 222/494 |

*Primary Examiner*—Andres Kashnikow
*Assistant Examiner*—Robin O. Evans
*Attorney, Agent, or Firm*—Pennie & Edmonds

[57] ABSTRACT

The present invention relates to a nozzle assembly for dosing liquid while preventing spillage or dripping between the dosing. This nozzle assembly includes a dosing chamber (4) has an inlet (21), a piston housing wherein a piston plunger (5) is disposed, and an outlet (22) communicating with a distribution channel (10), a first one-way valve to open the inlet (21) when the dosing chamber (4) is being filled and to close the inlet (21) when a dose is being emptied out from the dosing chamber (4) into the distribution channel. The nozzle assembly furthermore comprises a second one-way valve (3) and a pressure release valve (23) to open a distribution channel outlet (27) when pressurized to a desired pressure. This pressure release valve (23) has an elastic cover (19) tightly fitted around the distribution channel outlet (27) and a distribution chamber having one or more needles (13) through which the liquid is dosed. The invention also relates to a process for dosing of a liquid while preventing dripping between the doses.

14 Claims, 4 Drawing Sheets

DOSING NOZZLE ASSEMBLY AND PROCESS FOR DOSING LIQUID

TECHNICAL FIELD

The present invention relates to a nozzle assembly for dosing a liquid while preventing dripping or spillage of the liquid between the doses and to a process for dosing liquid without dripping or spillage between the doses.

BACKGROUND ART

Spilling and dripping of liquids onto any type of machine is undesirable. However, when dosing food products very high requirements to the hygienic environment and low product contamination are a necessity. Avoiding spillage and dripping is therefore important, especially when dosing sugar containing liquids such as syrup, machinery, conveyors, rollers etc. get extremely sticky, which increases the risk of contamination and makes cleaning of the machinery difficult.

Different types of dosing nozzles available aim to remedy dripping. For example, it is known to employ capillary pipes, i.e. very thin pipes, which may hold back fluid in the pipes after the end of a dosing sequence and before the subsequent dosing sequence. The capillary pipes are thus used to reduce the dripping effect of a nozzle. Such a dosing assembly is e.g. disclosed in published German patent application DE 2.841.198.

However, when the weight of the liquid column above the pipes is too high, the pressure of the column affects the liquid in the pipe with a downward force and the capillary effect will not be able to sufficiently retain the liquid. As a result, it is no longer possible to adequately control the discharge from the nozzle and hence dripping will occur. Difficulties in avoiding inter-sequence discharge of a liquid product are addressed in U.S. Pat. No. 4,846,379. This nozzle assembly, though employing thin pipes, does not adequately solve the problem of sequential dosing without intermediate dripping. The nozzle assembly comprises annular discharge orifices which have disadvantages in respect of coanda effects around the discharge orifices, i.e. liquid adhering to the discharge area due to surface friction.

SUMMARY OF THE INVENTION

The present invention aims to minimise the pressure upon the liquid in capillary needles from other liquid which eventually is supplied to the needles. It allows only a very thin layer of liquid to be distributed to the needle inlet at a time.

The invention also substantially eliminates the coanda effect by providing a very thin discharge pipe which is pointed so as to substantially hinder any discharged liquid from adhering to the outer needle.

Furthermore, the invention prevents the unnecessary waste of material by avoiding dripping and spillage of the liquid product to be dosed, and provides precise dosage of measured volumes.

Accordingly, in a first aspect, the invention relates to a nozzle assembly for dosing liquid comprising

- a dosing chamber comprising an inlet, a piston housing wherein a piston plunger is disposed the displacement of which enlarges or decreases the volume of the dosing chamber corresponding to the volume of a dose, and an outlet communicating with a distribution channel
- a first one-way valve to open the inlet when the dosing chamber is being filled and to close the inlet when a dose is being emptied out from the dosing chamber into the distribution channel,
- a second one-way valve to close the outlet when the dosing chamber is being filled and to open the outlet when a dose is being emptied from the dosing chamber into the distribution channel,
- a pressure release valve to open a distribution channel outlet when pressurised to a desired pressure, said pressure release valve comprising an elastic cover tightly fitted around the distribution channel outlet only allowing passage of liquid upon reaching of the desired pressure in the distribution channel to distribution means comprising one or more needles through which the liquid is dosed.

The present invention solves the problem of liquid pressure upon liquid in capillary needles from liquid which is to be dosed through the needles successively by providing a blockage between the liquid column above the distribution means. The distribution means comprises a distributing chamber which is so low that only a very thin film of liquid is distributed to inlets of the needles. By providing the tightly fitted elastic cover no liquid will be admitted to the distribution chamber unless the liquid on the other side of the pressure release valve is at a desired value. This means that only during the emptying of the dosing chamber will liquid be passed forward and through the pressure release valve. Furthermore, it is not possible for liquid to pass in the reverse direction as no pressure which is high enough to affect such a passage can be built up in the distribution means which are in direct communication with the surroundings. Therefore, no liquid or liquid containing air will be sucked back into the nozzle assembly.

The first one-way valve controls the inlet of liquid into the dosing chamber and the second one-way valve controls the outlet. The second one-way valve furthermore eliminates suction of liquid from the distribution channel into the dosing chamber at the piston return stroke. The second one-way valve is disposed between the dosing chamber and the pressure release valve. This will further divide the liquid supply passage which may be necessary where supply passages are long and result in high liquid columns which cause undesirable downwards forces upon the pressure release valve. Additional valves may be disposed between the dosing chamber and the pressure release valve where appropriate.

As mentioned above it is very important, in order to avoid dripping, that the liquid be distributed to the needles in a very thin film. Therefore, it is preferred that the distributing chamber has a height of 0.5 to 0.1 mm, preferably about 0.3 mm above the needles.

It will be understood that the pressure which is necessary to open the pressure release valve and thus allows liquid to pass from the dosing chamber under the tightly fitted cover to the distribution means, will vary depending on the type of cover used and the tightness thereof.

The displacement of the piston plunger will hence enlarge and decrease the volume of the chamber in front of the piston plunger and thereby enable pressurising of liquid within the chamber. On its return stroke the piston plunger provides room for a subsequent dose in-filling. The dosing chamber is conveniently a tube comprising a branching-off defining the piston housing, preferably cylindrical, wherein the piston plunger is disposed.

It is preferred that the distribution means comprises a distribution chamber which is positioned above the needles and constantly substantially filled. The liquid dose which is allowed through the pressure release valve is distributed via the distribution chamber and pressed through the needles. When no more liquid is advanced, that is at the end of a discharge, nothing will press forward the liquid which is on its way from the distributing chamber and through the distribution channel. Consequently, the liquid which is in the needles will not be influenced from any substantial downwards pressure and thus the liquid will be hanging there due to the capillary effect of the needles. In the above described way, it is possible to dose liquid doses substantially without any dripping between the doses.

Remarkably good results have been obtained where the distribution channel is an endless tube comprising at least one outlet opening in its side wall and the elastic cover is a sleeve co-axially and tightly positioned only allowing passage of liquid upon reaching of the desired pressure. In this embodiment of the invention the liquid will pass from the inner tube, which is communicating with the dosing chamber, in between the outer tube and the inner side of the elastic sleeve and further to the distribution means.

It is important that the elastic material is resistant to a constant enlarging and contraction without loosening the fitting of the cover or sleeve. A suitable material for the elastic cover or sleeve is elastic and flexible plastics. The elastic material is preferably silicone which can be used in connection with food products.

Although the distribution chamber may be of various configurations, a cylindrical and preferably disc shaped distribution chamber provides a good distribution for many purposes, see e.g. the embodiment of the invention discussed in connection with the accompanying drawings.

The capillary needles used in the nozzle according to the invention preferably have an inner diameter from 0.8 to 1.2 mm, preferably about 1.0 mm. The small dimensions are essential in order to obtain an appropriate capillary effect.

In a preferred embodiment of the nozzle the first and/or the second one-way valve is/are a spring biased one-way ball valve or valves. If an additional one-way valve or valves is/are disposed between the dosing chamber and the pressure release valve such valve or valves may advantageously as well be a spring biased one-way ball valve or valves.

As discussed above, the invention also provides substantial elimination of the coanda effect around the outlet of the needles by providing a very thin discharge pipe which is pointed so as to substantially hinder any discharged liquid from adhering to the outer needle.

Eliminating the coanda effect is important in order to avoid dripping as liquid drops which are hanging on the outside of the needles after the end of a dosing sequence and which are likely to be released from the needle by very little vibration of the needle or due to the force of gravity if the size of the drop increases. Various types of needle designs have been considered and may be used; the more pointed the better. However, surprisingly good results have been obtained with needles which at their discharge ends are cut-off at an angle from 30 to 60 degrees, preferably 45 degrees to the longitudinal axis of the needles.

In a second aspect, the invention relates to a process which prevents dripping and spillage between the dosing sequences. This process for dosing liquid comprises the step of:

dosing liquid from a dosing chamber comprising an inlet, a piston housing wherein a piston plunger is disposed, and an outlet communicating with a distribution channel, opening the inlet when the dosing chamber is to be filled and closing the inlet when a dose is to be emptied out from the dosing chamber by means of a first one-way valve, closing the outlet when the dosing chamber is to be filled and opening the outlet when a dose is to be emptied out from the dosing chamber by means of a second one-way valve, pressing the liquid from the dosing chamber to the distribution channel by displacing the piston plunger to decrease the volume of the dosing chamber, and allowing passage of liquid from the distribution channel by means of a pressure release valve opening a distribution channel outlet when pressurised to a desired pressure, said pressure release valve comprising a elastic cover tightly fitted around the outlet only allowing passage of liquid upon reaching of the desired pressure in the distribution channel to distribution means comprising one or more needles through which the liquid is dosed.

BRIEF DESCRIPTION OF THE DRAWINGS

The invention will now be described in further detail, by way of example only, with reference to the accompanying drawings in which.

DETAILED DESCRIPTION OF THE PREFERRED EMBODIMENTS

Figure 1:
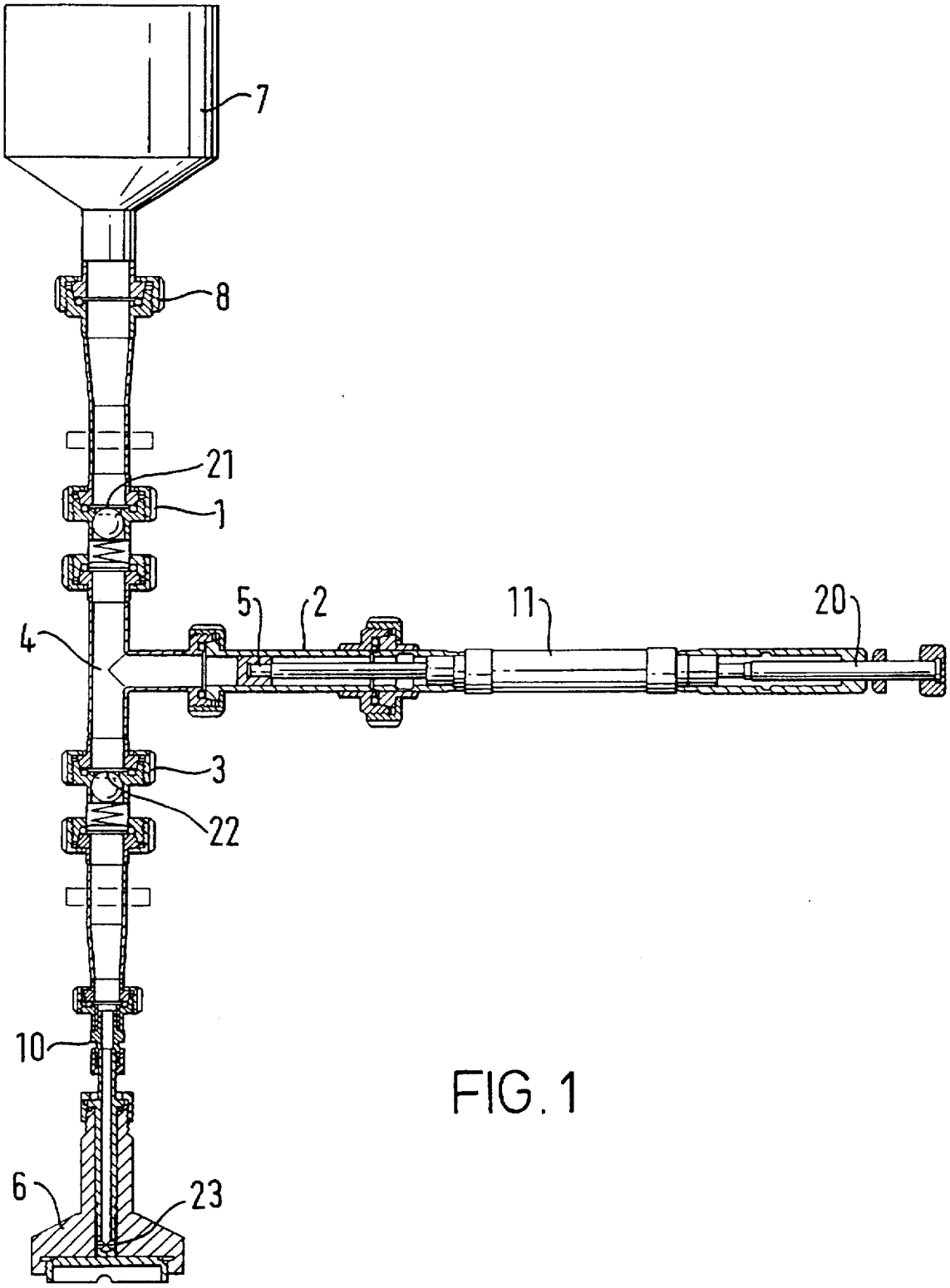
FIG. 1 is a schematic illustration of the nozzle according to a preferred embodiment of the invention.

FIG. 1 shows a preferred embodiment of a nozzle according to the invention. Comprised in the nozzle is a dosing chamber 4 comprising an inlet 21 and an outlet 22. The opening and closing of the inlet 21 is controlled by means of a first one-way valve 1 which opens the inlet 21 when the dosing chamber 4 is being filled and closes the inlet 21 when a dose is being emptied out from the dosing chamber 4. The nozzle also comprises a second one-way valve 3 which is disposed between the dosing chamber and a pressure release valve 23. A distribution channel 10 is inserted between the dosing chamber 4 and the pressure release valve 23. The second one-way valve 3 divides this liquid supply passage and prevents the liquid in the distribution channel 10 and in the dosing chamber from providing undesirable downward forces upon the pressure release valve 23. In addition the second one-way valve prevents liquid in the distribution channel 10 from being sucked into the dosing chamber 4.

The dosing chamber 4 comprises a piston housing 2 wherein a piston plunger 5 is disposed the displacement of which enlarges or decreases the volume of the dosing chamber 4 corresponding to the volume of a desired dose. In the present embodiment of the invention the displacement is performed by means of a pneumatic cylinder 11, however, other motion means may be used. The volume of the dose can be adjusted by means of screw threaded adjustment means 20 displacing the piston plunger 5 independently of the movement the piston plunger 5 performs when it pumps doses from the dosing chamber 4.

Figure 3:
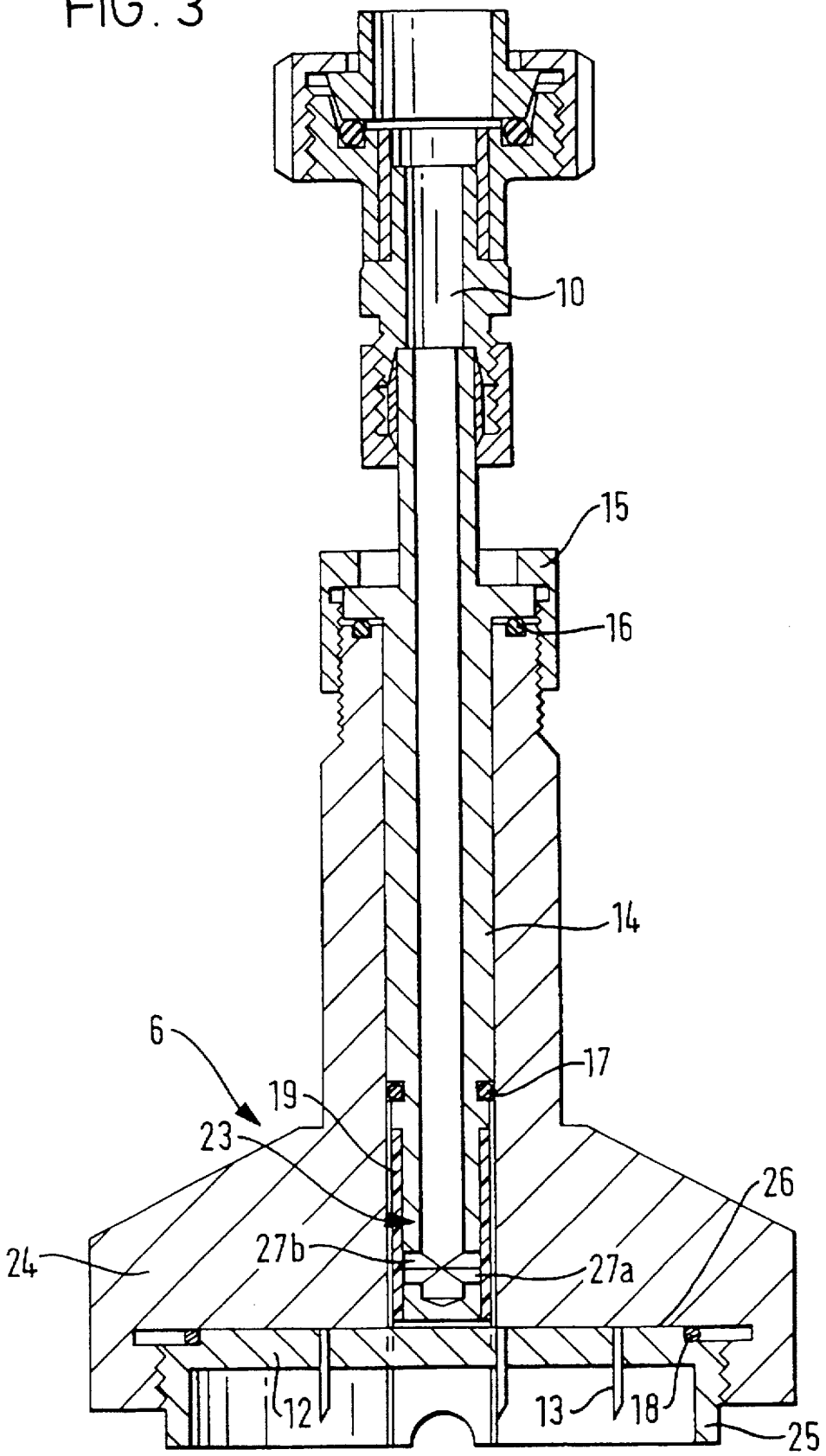
FIG. 3 is an enlarged schematic illustration of the distribution means.

The design of the pressure release valve 23 and liquid distribution means are shown in enlargement in FIG. 3. The pressure release valve 23 opens a distribution channel outlet 27 when pressurised to a desired pressure. This pressure release valve comprises an elastic cover in the form of an elastic sleeve 19 tightly fitted around the outlet 27 and only allowing passage of liquid upon reaching of the desired pressure in the distribution channel 10. The distribution channel outlet 27 in this preferred embodiment of the invention, shown in FIG. 3 comprises an endless tube 14 having two outlet openings 27*a* and 27*b* in its side wall. The elastic sleeve 19 is co-axially and tightly positioned so that only upon reaching of the desired pressure, liquid is allowed to pass. The elastic sleeve 19 and the endless tube 14 are mounted within an upper distributing housing 24 and secured therein by a cylindrical mounting sleeve 15. O-rings 16 and 17 are provided in order to prevent liquid from passing in between the tube and the upper distributing housing 24.

Figure 4:
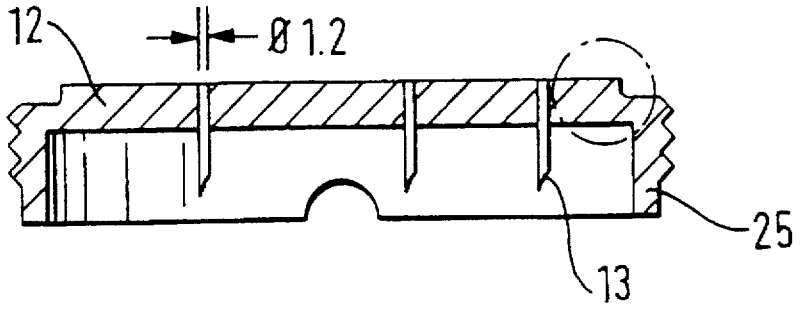
FIG. 4 is an enlarged schematic illustration of an embodiment of a lower housing part for fitting of needles and defining of a discharge chamber.
Figure 5:
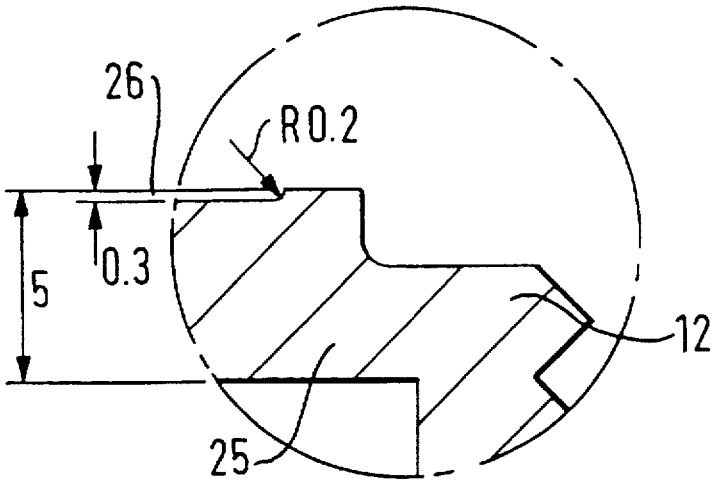
FIG. 5 shows details of the design of a lower housing defining the distribution chamber.

The distribution means comprises a lower housing part 25 which together with the upper distributing housing 24 defines the distribution chamber 26. In the preferred embodiment of the invention the distribution chamber 26 is a disk shaped cylindrical chamber. A tightening between the upper distribution housing 24 and the lower housing part 25 is obtained by the insertion of an O-ring 18. An enlargement of a part of the distribution chamber showing the lower housing part 25 is shown in FIGS. 4 and 5. The preferred dimensions of the height of the distribution chamber, namely 0.3 mm, is apparent from the drawing.

Capillary needles 13 for the discharge of the liquid are mounted within the lower housing part 25. The needles 13 preferably have an outer diameter about 1.2 mm and an inner diameter 1.0 mm. As discussed above, pointed needles 13 are important in order to avoid drops sticking to the outside thereof as these might fall from the needles 13 between the doses. In the embodiment illustrated in drawings, needles therefore have ends cut-off at an angle from 30 to 60 degrees, preferably 45 degrees, to the longitudinal axis of the needles. The enlargement in FIG. 4 shows the lower housing part 25 and with needles 13. It has been found that this type of needle limits dripping between doses.

The present nozzle assembly may be used for various types of liquid which is to be dosed accurately. Advantageously, it may be used for dosing viscous liquids such as syrup, e.g. mixtures of water, sugar with or without alcohol. Another example of a viscous liquid which may need to be dosed accurately is lactic acid.

Figure 2:
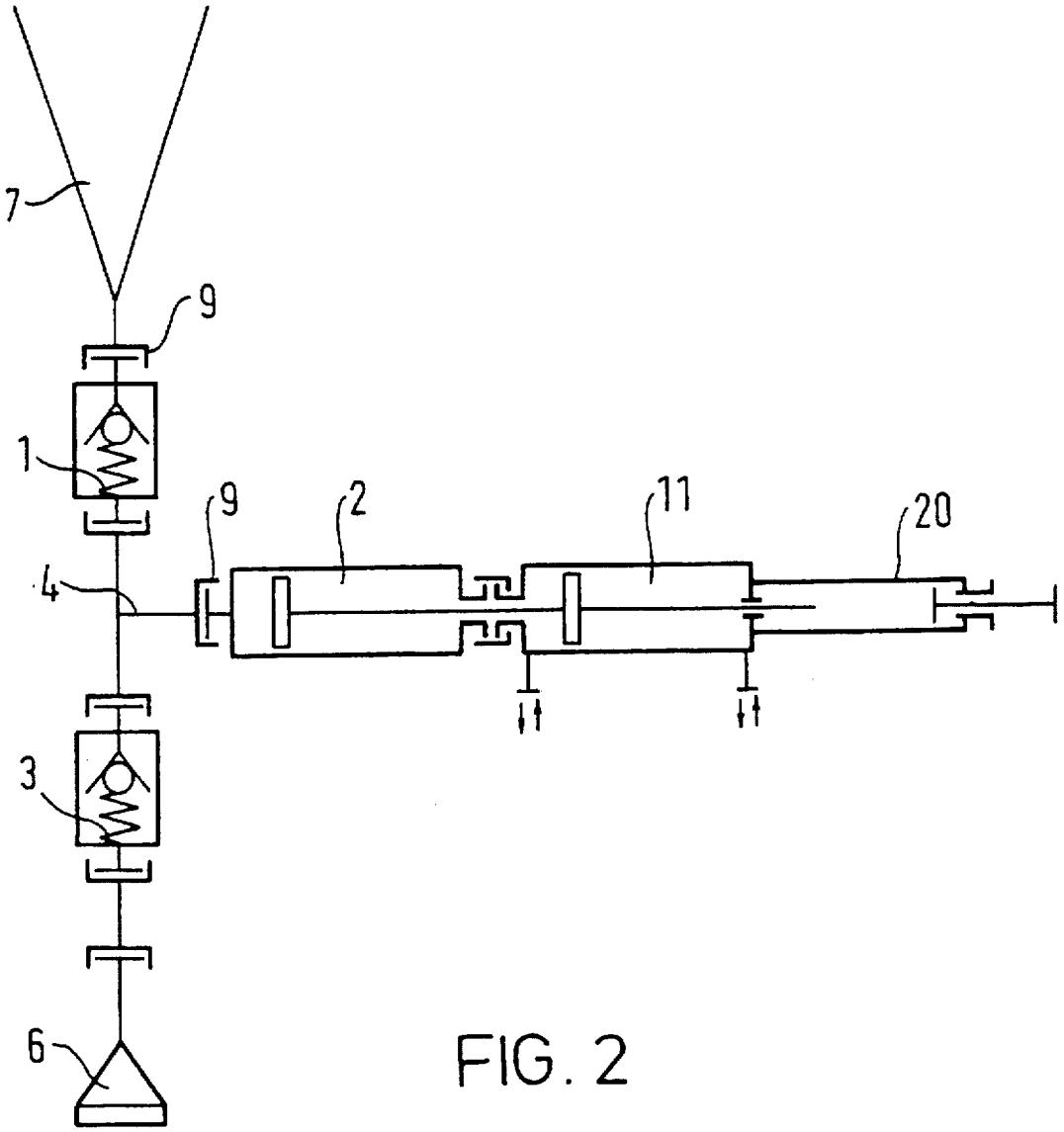
FIG. 2 illustrates schematically the principle of the nozzle assembly according to the invention.

FIG. 2 shows schematically the principle of functions of the nozzle assembly wherein reference number 7 is the liquid supply reservoir, 1 and 3 are the one-way ball valves, 2 is the piston housing, 5 is the piston plunger, 4 is the dosing chamber, 11 is the pneumatic cylinder, 6 is the distribution means, and 20 is the means for adjusting the volume of the dose. The direction of flow possible is indicated with the signs 9.

The liquid to be dosed with the nozzle and in accordance with a preferred process of the invention is supplied from the liquid supply reservoir 7 via a connecting pipe 8. The dosing is carried out by opening the inlet 21 when the dosing chamber 4 is to be filled and closing the inlet 21 when a dose is to be emptied out from the dosing chamber 4 by means of the one-way valve 1. The liquid in the dosing chamber 4, is then pressurised by displacing the piston plunger 5 whereby the chamber in front of the plunger 5 is decreased. As a consequence, the liquid is pressed through the second one-way valve 3 and advanced via the distributing channel 10 to the pressure release valve 23. Passage through this valve is possible due to the pressure of the liquid resulting from the advancing of the liquid from the dosing chamber 4. Passage is allowed through the pressure release valve 23 and thus through the distribution channel outlet 27 to the distributing chamber when liquid in the distribution channel 10 is pressurised to a desired pressure. From the distributing chamber 26 the liquid being distributed in a thin film reaching the upper end of the needles 13 is discharged there through.

When the desired dose has been emptied out of the dosing chamber 4 the second one-way valve 3 will close and the first one-way valve open so that the liquid can be supplied to the dosing chamber 4 for the subsequent dose. When no more liquid is pressed forward from the dosing chamber 4 the pressure release valve 23 will close and block any pressure influence that might have resulted from the liquid above the pressure release valve 23. After the closure of the pressure release valve 23 no more liquid will advance to the needles 13 and thus the liquid remaining therein is only influenced by any downwards pressure from the very thin liquid film above the needles. The liquid hanging in the needles will remain there due to the capillary effect being greater than the gravity force on the thin film. Whereas any outside drops will glide from the needles immediately as a result of which no dripping will occur between the discharge of doses.

What is claimed is:

1. Nozzle assembly for dosing liquid comprising a dosing chamber comprising an inlet, a piston housing wherein a piston plunger is disposed the displacement of which enlarges or decreases the volume of the dosing chamber corresponding to the volume of a dose, and an outlet communicating with a distribution channel a first one-way valve to open the inlet when the dosing chamber is being filled and to close the inlet when a dose is being emptied out from the dosing chamber into the distribution channel, a second one-way valve to close the outlet when the dosing chamber is being filled and to open the outlet when a dose is being emptied from the dosing chamber into the distribution channel, a pressure release valve to open a distribution channel outlet when pressurised to a desired pressure, said pressure release valve comprising an elastic cover tightly fitted around the distribution channel outlet only allowing passage of liquid upon reaching of the desired pressure in the distribution channel to distribution means comprising one or more needles through which the liquid is dosed.

2. Nozzle assembly according to claim 1, wherein the distribution means comprises a distribution chamber which is positioned above the needles and constantly substantially filled, said chamber having a height of 0.5 to 0.1 mm above the needles.

3. Nozzle assembly according to claim 1, wherein the distribution channel is an endless tube having at least one outlet opening in its side wall and the elastic cover is a sleeve co-axially and tightly positioned only allowing passage of liquid upon reaching the desired pressure.

4. Nozzle assembly according to claim 1, wherein the distribution chamber is a cylindrical disk.

5. Nozzle assembly according to any of claim 1, wherein the needle has an inner diameter from 0.8 to 1.2.

6. Nozzle assembly according to claim 1, wherein the first one-way valve is a spring biased one-way ball valve.

7. Nozzle assembly according to claim 1, wherein the second one-way valve is a spring biased one-way ball valve.

8. Nozzle assembly according to claim 1, wherein the needles at the discharge end are cut-off at an angle from 30 to 60 degrees to the longitudinal axis of the needles.

9. A process for dosing liquid comprising dosing liquid from a dosing chamber comprising an inlet, a piston housing wherein a piston plunger is disposed, and an outlet communicating with a distribution channel, opening the inlet when the dosing chamber is to be filled and closing the inlet when a dose is to be emptied out from the dosing chamber by means of a first one-way valve, closing the outlet when the dosing chamber is to be filled and opening the outlet when a dose is to be emptied out from the dosing chamber by means of a second one-way valve, pressing the liquid from the dosing chamber to the distribution channel by displacing the piston plunger to decrease the volume of the dosing chamber, allowing passage of liquid from the distribution channel by means of a pressure release valve opening a distribution channel outlet when pressurised to a desired pressure, said pressure release valve comprising an elastic cover tightly fitted around the outlet only allowing passage of liquid upon reaching of the desired pressure in the distribution channel to distribution means comprising one or more needles through which the liquid is dosed.

10. The method according to claim 9, wherein the distribution means comprises a distribution chamber which is positioned above the needles, and which further comprises substantially constantly filling the chamber to provide a continuous supply of liquid.

11. The method according to claim 9, wherein the distribution chamber is an endless tube having at least one outlet opening in its side wall and the elastic cover is a sleeve co-axially and tightly positioned thereon, and which further comprises allowing passage of liquid through the tube only after the desired pressure is reached.

12. The method according to claim 9, which further comprises biasing the first one way valve with a spring.

13. The method according to claim 9, which further comprises biasing the second one way valve with a spring.

14. The method according to claim 9, which further comprises cutting the needles at the discharge end at an angle from 30 to 60 degrees.

* * * * *